United States Patent [19]

Ohba et al.

[11] 4,406,728

[45] Sep. 27, 1983

[54] APPARATUS FOR BINDING ARTICLES WITH TAPE

[75] Inventors: Hiroshi Ohba; Shigeo Horino, both of Tokyo, Japan

[73] Assignee: Tokyo Shibaura Denki Kabushiki Kaisha, Kawasaki, Japan

[21] Appl. No.: 318,798

[22] Filed: Nov. 6, 1981

[30] Foreign Application Priority Data

Nov. 11, 1980 [JP] Japan ..... 55-158544

[51] Int. Cl.[3] ..... B29C 17/00

[52] U.S. Cl. ..... 156/468; 53/528; 53/582; 53/588; 53/589; 100/27; 100/33 PB; 156/475; 156/522

[58] Field of Search ..... 100/10, 17, 18, 20, 100/27, 28, 29, 33 R, 33 PB, 14; 53/580, 582, 586, 588, 528; 156/475, 468, 251, 515, 522

[56] References Cited

U.S. PATENT DOCUMENTS

| | | | |
|---|---|---|---|
| 2,837,884 | 6/1958 | Gibbons | 100/27 UX |
| 3,574,038 | 4/1971 | Wolfe | 156/515 |
| 3,665,845 | 5/1972 | Lyon | 100/27 |
| 4,014,731 | 3/1977 | Muto | 100/17 X |
| 4,262,587 | 4/1981 | Russell | 100/14 X |

*Primary Examiner*—David A. Simmons

*Attorney, Agent, or Firm*—Cushman, Darby & Cushman

[57] ABSTRACT

This invention discloses apparatus for binding an article, such as a pack of bank notes, with a tape in a binding position. For this purpose, with rotation of a rotating member, the tape is supported by tape loop supporting pins and is wound to form a loop before a binding operation. The article is pushed into the loop and pressed before the tape is wound around the article. The tape supporting pins are retracted to disengage from the loop. The tape is drawn in a direction opposite to the supplying direction so as to be wound tightly around the article, and the trailing end of the tape is cut. The cut end of the tape is adhered to an adjacent portion of the tape. In this manner, tape binding is completed.

18 Claims, 30 Drawing Figures

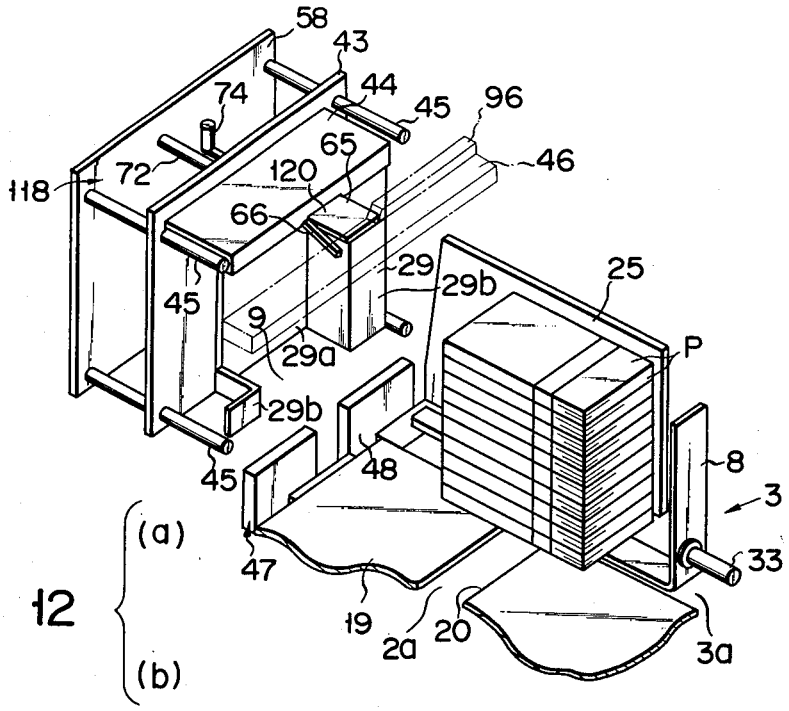
FIG. 12
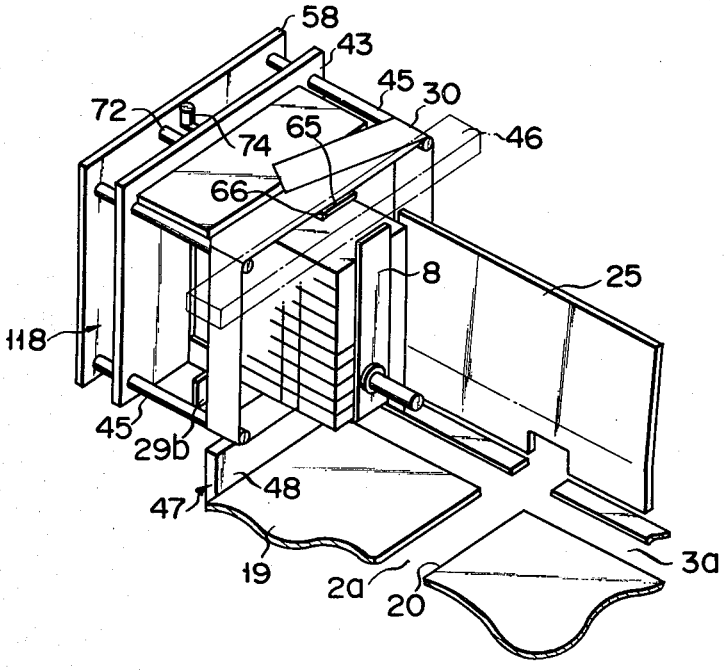

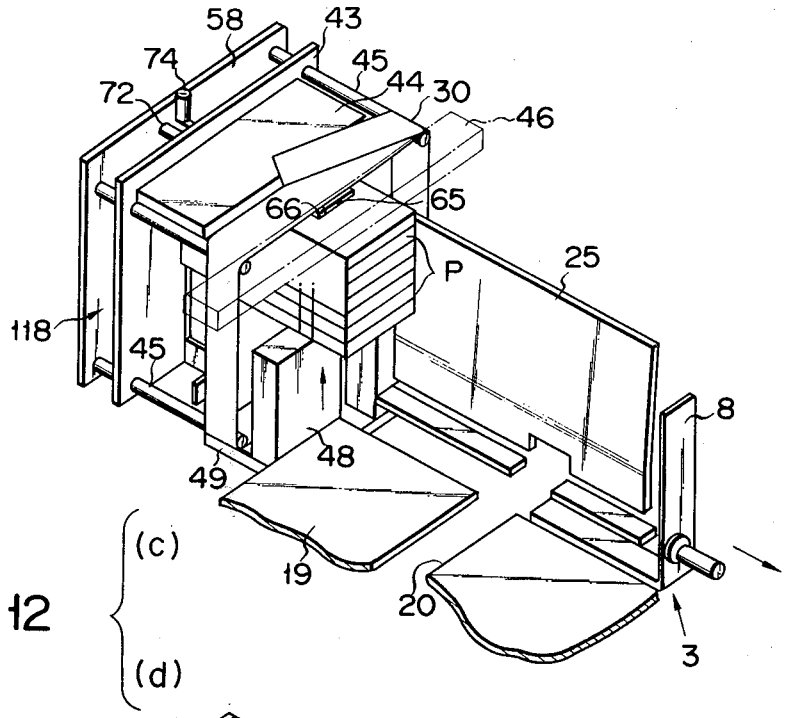
FIG. 12
(c)
(d)
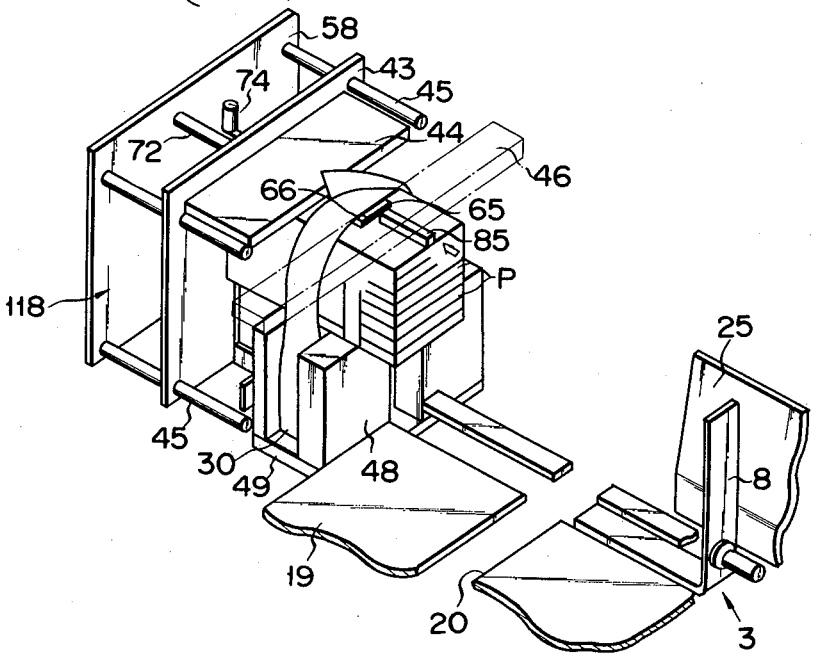

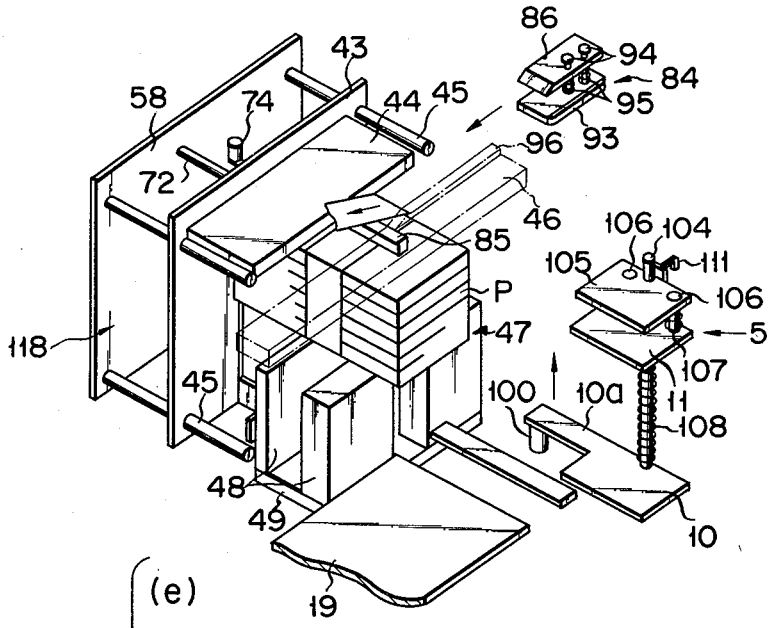
FIG. 12
(e)
(f)
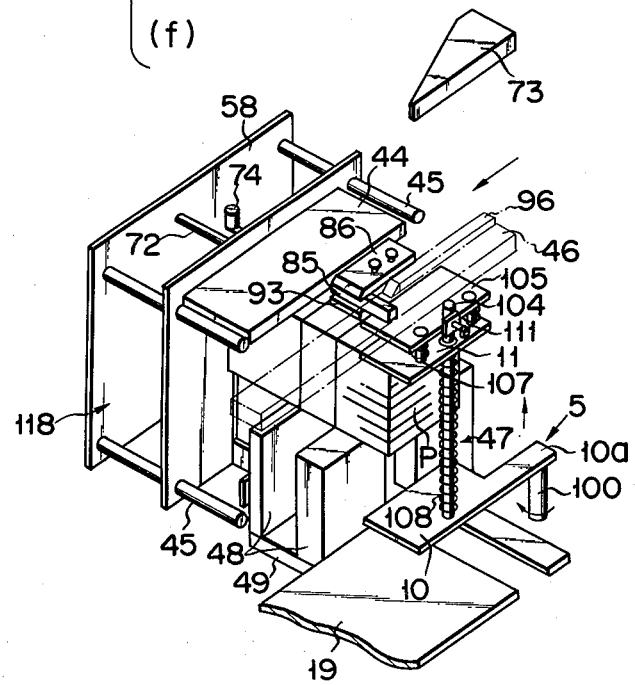

(g)

(h)

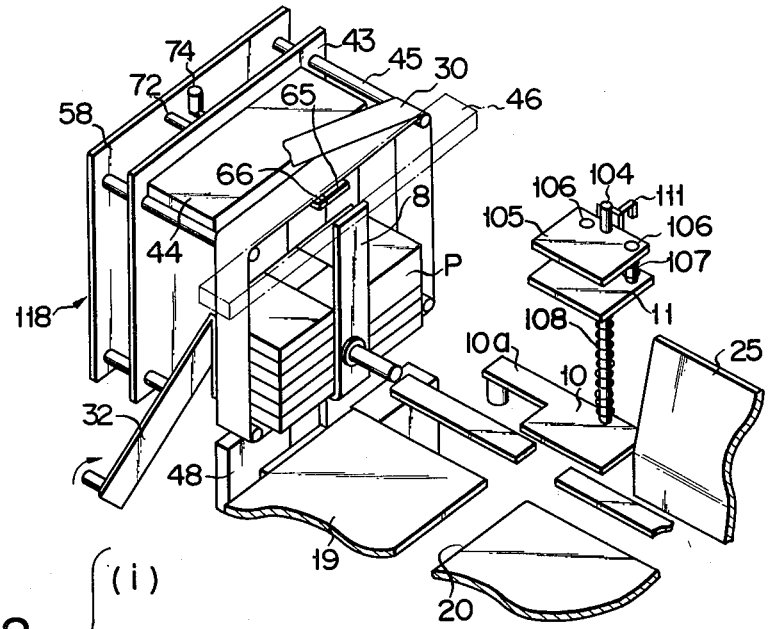
FIG. 12
(i)
(j)
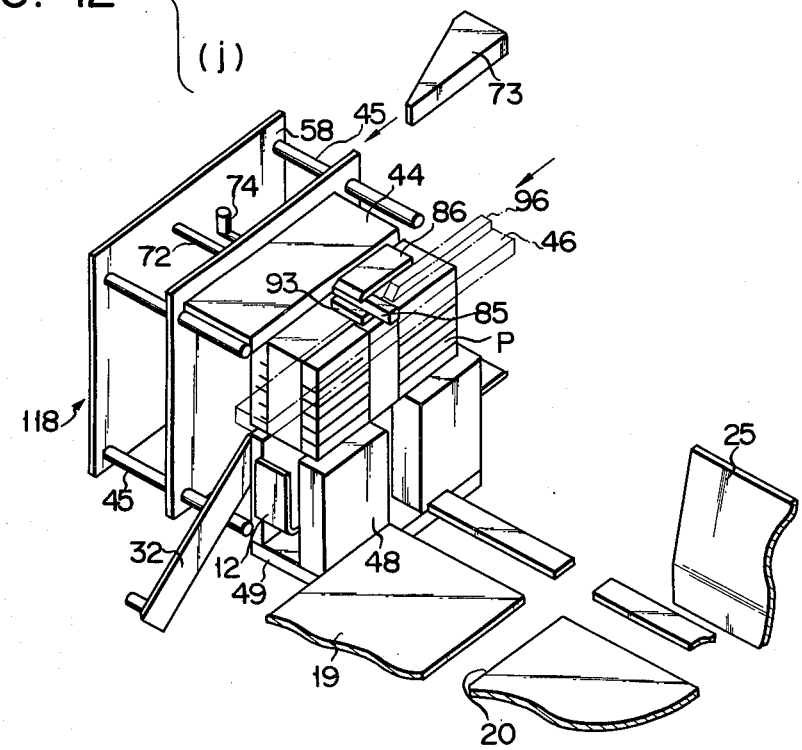

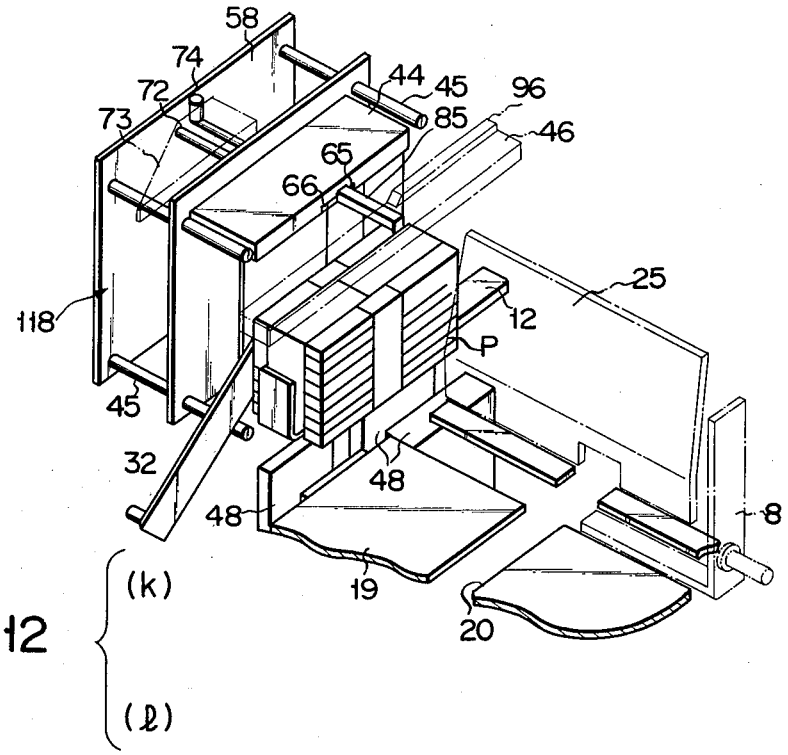
FIG. 12
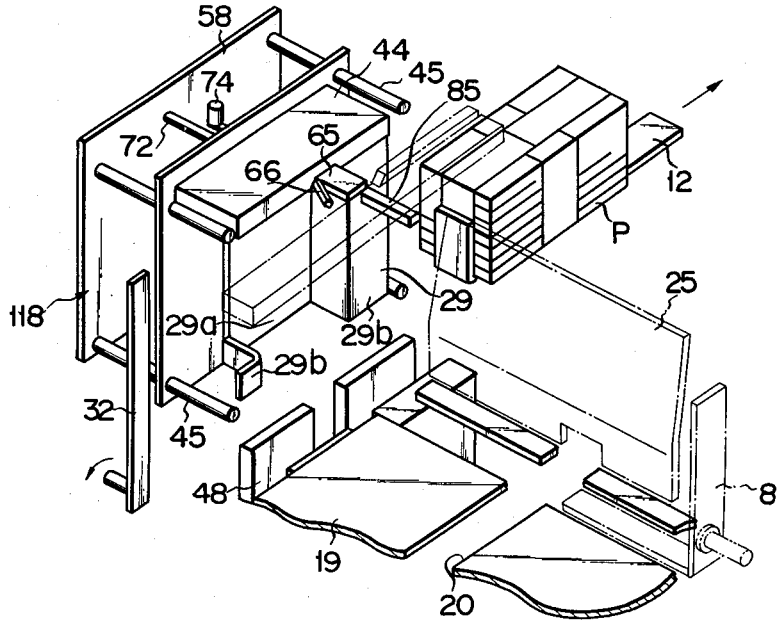

APPARATUS FOR BINDING ARTICLES WITH TAPE

BACKGROUND OF THE INVENTION

The present invention relates to an apparatus for binding with a tape a pack of paper sheets such as bank notes or securities, particularly, a three-dimentional rectangular parallelepiped article.

Various types of apparatus have been developed as a bundling unit for bank notes in a bundling system used in a main bank.

In order to generally describe the mode of operation of this apparatus, a paper currency bundling system is shown in FIGS. 1 and 2. According to this system, paper currency is evaluated and sorted into fit bills which can be used again or circulated, and unfit bills which have monetary value but are removed from circulation. A plurality of apparatuses a for binding a predetermined number, for example, 100 sheets of the fit bills and the unfit bills with different colors of bands, respectively, are disposed parallel to each other. A paper bill bundle fed out from the apparatuses for binding the bundles with bands is carried on a common feeding passage b. The color of the bands of the fit and unfit bundles is detected by a color detector c which is disposed in the vicinity of the feeding passage b. A detection signal for a green band representing a fit bundle Pa and a detection signal for a yellow band representing an unfit bundle Pb are output at the color detector c. In response to these signals, a fit bundle gate d and an unfit bundle gate e selectively operate to interrupt feeding of the fit bundle Pa or the unfit bundle Pb. In synchronism with the operation of the fit bundle gate d or the unfit bundle gate e, a fit bundle pushout unit f or an unfit bundle pushout unit g starts operating to carry the fit bundle Pa or the unfit bundle Pb, which is pushed out from the feeding passage b, to a fit bundle feeding passage h or an unfit bundle feeding passage i.

The fit bundle Pa or the unfit bundle Pb is stacked on another fit bundle Pa or unfit bundle Pb which is fed out immediately before the current fit bundle Pa or the current unfit bundle Pb. Two stacked fit bundles Pa or two stacked unfit bundles Pb are fed to a fit bundle stacking unit j or an unfit bundle stacking unit k.

Before the unfit bundles Pb are burned in a furnace or dissolved in a solvent, predetermined areas of the unfit bundles, such as the currency number, the seal, and the signature must be punched out by a punching machine in order to avoid circulation of the currency.

For this purpose, an invalidating unit l is arranged in the middle of the unfit bundle feeding passage i before the unfit bundle stacking unit k.

When ten fit bundles Pa or ten unfit bundles Pb are stacked in the fit bundle stacking unit j or the unfit bundle stacking unit k, a group of fit bundles Pa or unfit bundles Pb are pushed out into a fit bundle group holding unit o or an unfit bundle group holding unit p by a pushout unit m or a pushout unit n.

When a table of a feeding mechanism of a binding unit q for binding together a group of fit bundles Pa or group of unfit bundles Pb is not occupied by a group of fit bundles Pa or a group of unfit bundles Pb, the fit bundle group holding unit o or the unfit bundle group holding unit p sends a group of fit bundles Pa or a group of unfit bundles Pb to the feeding mechanism of the binding unit q.

An article, i.e. the group of fit bundles Pa or the group of unfit bundles Pb is bound by two strips of tape in a cross shape by the binding unit q, this tape being a heat-sealable tape wider than the band previously described.

A bound article $P_1$ of paper bill bundles is fed to a detector r through an outfeed mechanism of the binding unit q. The weight and thickness of the bound article $P_1$ are measured to check whether or not the bound article $P_1$ consists of 10 fit bundles Pa or 10 unfit bundles Pb. When the bound article $P_1$ consists of 10 bundles, the bound article $P_1$ is pushed out onto a table u by an article pushout unit s or t. A plurality of bound articles $P_1$ are stacked on a table u. However, when the bound article $P_1$ does not consist of 10 bundles, the bound article $P_1$ is fed as a bound article $P_2$ through a feeding passage v and is led to a rejected article stacking unit w.

The color detector c detects the length and width of the bundle as well as the color of the band of the bundle. Therefore, if one sheet is not aligned with other sheets, this misalignment is detected. Thus, the detected bundle is defined as a defective bundle Pc. When the defective bundle Pc is detected, the gates d and e do not operate and the detective bundle Pc is led to a rejected bundle stacking unit x which is arranged at the terminal end of the feeding passage b. The band around the bundle after the binding step in the binding unit q is omitted in the figure.

In the bank bundling system, the unit q which tightly binds the article with a tape at high speed is required.

In order to accomplish the above high performance, U.S. Pat. No. 4,014,731 discloses that a tape loop is formed in advance by a cylindrical tape guide before an article is fed to the binding position, the article is fed within this loop, and the article is bound with a tape.

In a system in which a tape loop is formed, while a bound article is fed out from the binding position and the next article is fed to the binding position, the next loop may be formed, preferably decreasing the overall operating time.

However, in this known binding apparatus, the leading end of the tape must be inserted into a narrow voluted tape guide passage within a guide. A flexible tape may become clogged in the middle of the guide passage. Furthermore, the guide passage must has a smooth shape, e.g., a curved shape. Therefore, if the loop to be formed is not considerably large, a rectangular parallelepiped article cannot be inserted in the loop. For this reason, the distance of the guide passage becomes long, requiring more time for the process. The length of the excess tape is quite long when the tape is tightened around the articles.

SUMMARY OF THE INVENTION

It is, therefore, the object of the present invention to provide a binding apparatus which permits shortening the time required for the binding process and also permits tightly binding the article without fail.

According to the present invention, the conventional narrow passage for forming a loop is eliminated, and a rotating member guides a plurality of tape supporting members which are reciprocally movable. With a rotation of the rotating member, tape is wound around these supporting members to form a loop. The formed tape loop is released from the supporting members when it is moved backward and the tape loop is wound around the article disposed in the binding position.

The rotating member is preferably of rectangular shape, and the supporting members are of pin shape and are arranged at the corners of the rotating member so as to project perpendicularly to the rotating surface of the rotating member. In this manner, the loop may be of rectangular shape, so that the inside width of the loop comes close to the outside width of the rectangular article. Further, when the tape is tightened around the article, the length of the tape to be pulled becomes short, and the binding operation is performed in a short period of time.

In accordance with the basic arrangement of the present invention, the tape is formed in a loop quickly and positively and the leading end of the tape does not become clogged in the course of the feeding passage.

In the binding apparatus according to the present invention, the article is passed before the tape is wound around the article, the tape is wound around the pressed article, and the excess tape is cut off. The tape end is attached to the binding tape, and then the pressure is released from the article, thus obtaining tight binding.

A mechanism which presses the article is preferably constituted by a stationary pressing table means, which is stationary in the direction of pressing and which faces one surface of the article, and movable pressing table means which is movable in the direction of pressing for pressing the article toward the stationary pressing table and which faces the other surface of the article. The movable pressing table means is provided with a first groove and a second groove which crosses the first groove, wherein the first groove is defined as a feeding passage for pushing the article in the binding position, and the second groove is defined as an outfeed passage for feeding out the article from the binding position. The second passage is also used as a passage for the tape to be wound. Therefore, the article is kept in a well-pressed condition independently of the tape binding operation. Further, since the tape loop is partially disposed in the second groove, movement of the loop accompanying the movement of the tape supporting members is prevented by the wall surface of the second groove when the tape supporting members are pulled from the loop, accomplishing smooth pullout operation.

In addition to the basic arrangement of the binding apparatus according to the present invention, various modifications and changes are proposed, which will be apparent from the description of the preferred embodiment with reference to the accompanying drawings hereinafter.

DETAILED DESCRIPTION OF THE PREFERRED EMBODIMENT

Figure 1:
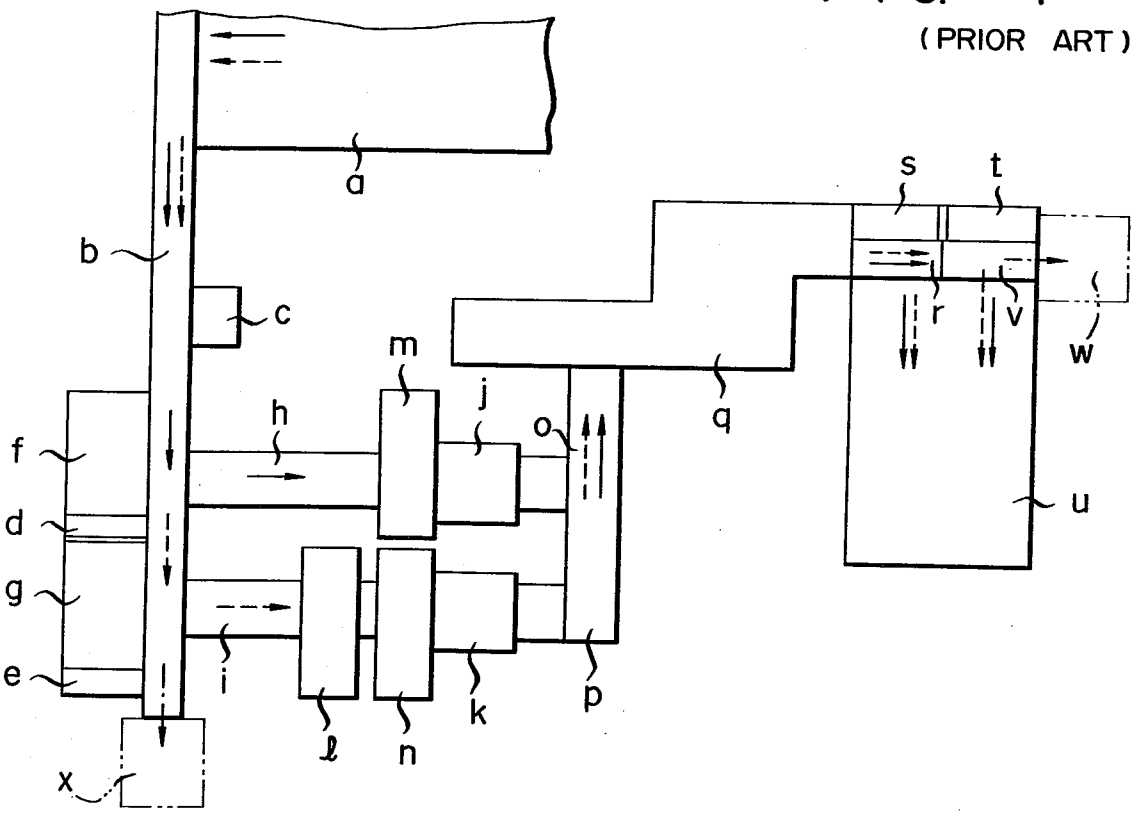
FIG. 1 (PRIOR ART)
FIGS. 1 and 2 show a schematic system, for explaining the background of the present invention, of a generally known bank currency bundling system which may adopt a binding apparatus of the present invention.
Figure 2:
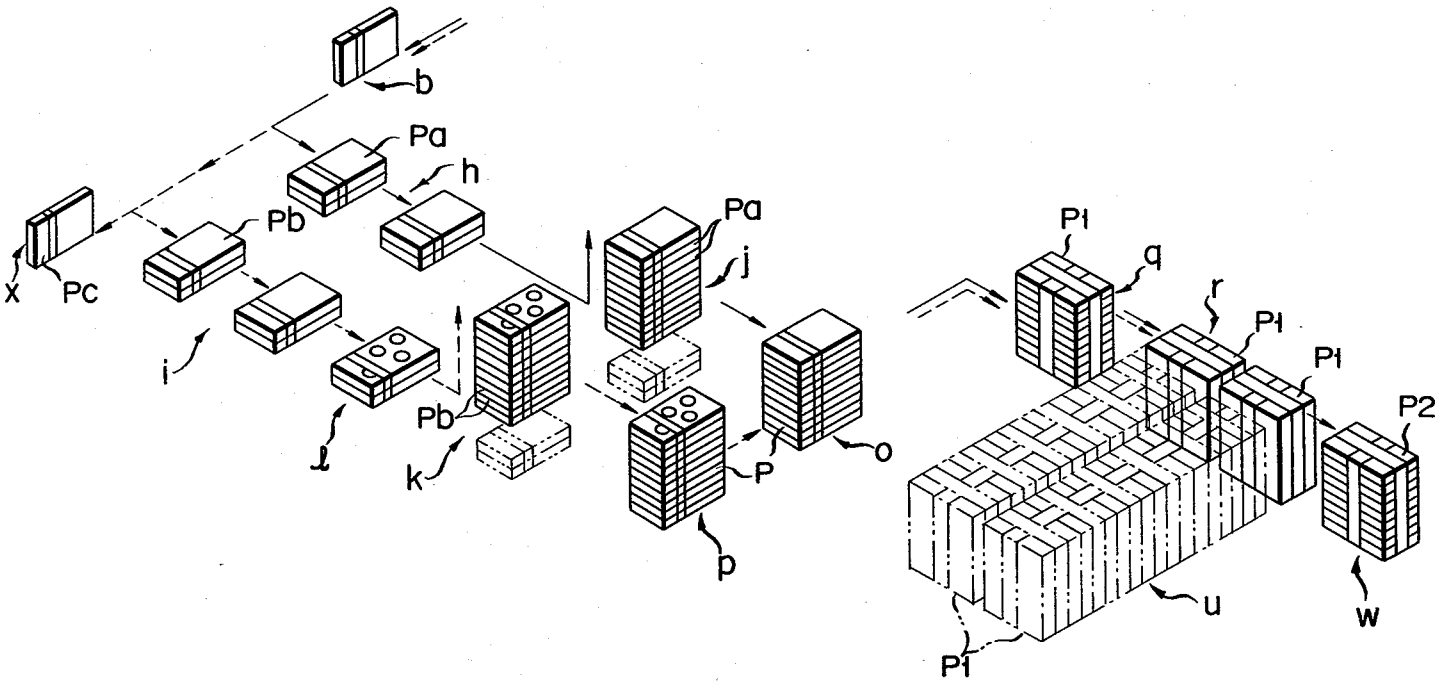
FIG. 2 (PRIOR ART)
Figure 3:
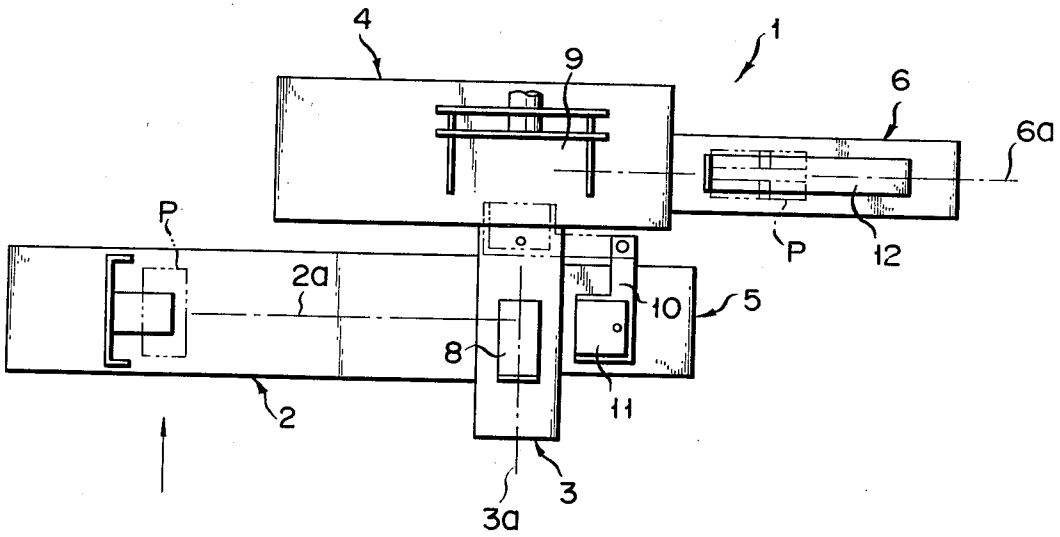
FIG. 3 is a plan view for schematically illustrating a detailed section of a binding apparatus according to the present invention.

The embodiment of the present invention will be described referring to FIGS. 3 to 12. Referring to FIG. 3, a binding apparatus 1 comprises a feeding mechanism 2, a push-in mechanism 3, a binding mechanism 4, a turning mechanism 5 and a take-up mechanism 6.

The feeding mechanism 2 picks up a rectangular parallelepiped article P, such as a pack of bank notes on the table 7 fed in the direction indicated by the arrow, and feeds the article P to a position corresponding to an inlet port of the binding mechanisms 4 through a feeding passage 2*a*. The take-up mechanism 3 pushes, by a take-up table 8, the article out into a tape binding position 9 of the binding mechanism through a take-up passage 3*a* in the perpendicular direction.

The binding mechanism 4 binds with a tape the article P which is pushed in by the push-in mechanism 3 as the material to be bound. The turning mechanism 5 temporarily removes from the tape binding position 9 the article bound with the tape along one direction thereof upon the first binding operation, with a turning table 10 and a clamping plate 11 which turn the article 90 degrees. The turned article is pushed again into the tape binding position 9 of the binding mechanism 4 by the push-in mechanism 3, in order to bind the article with the tape in a cross shape.

The take-up mechanism 6 feeds out, with an take-up table 12, the article P which is bound in a cross shape with the tape after the second binding operation by the binding mechanism 4, from the tape binding position 9 through an take-up passage 6*a*.

The arrangement of the above units will be described with reference to FIG. 4.

Figure 5:
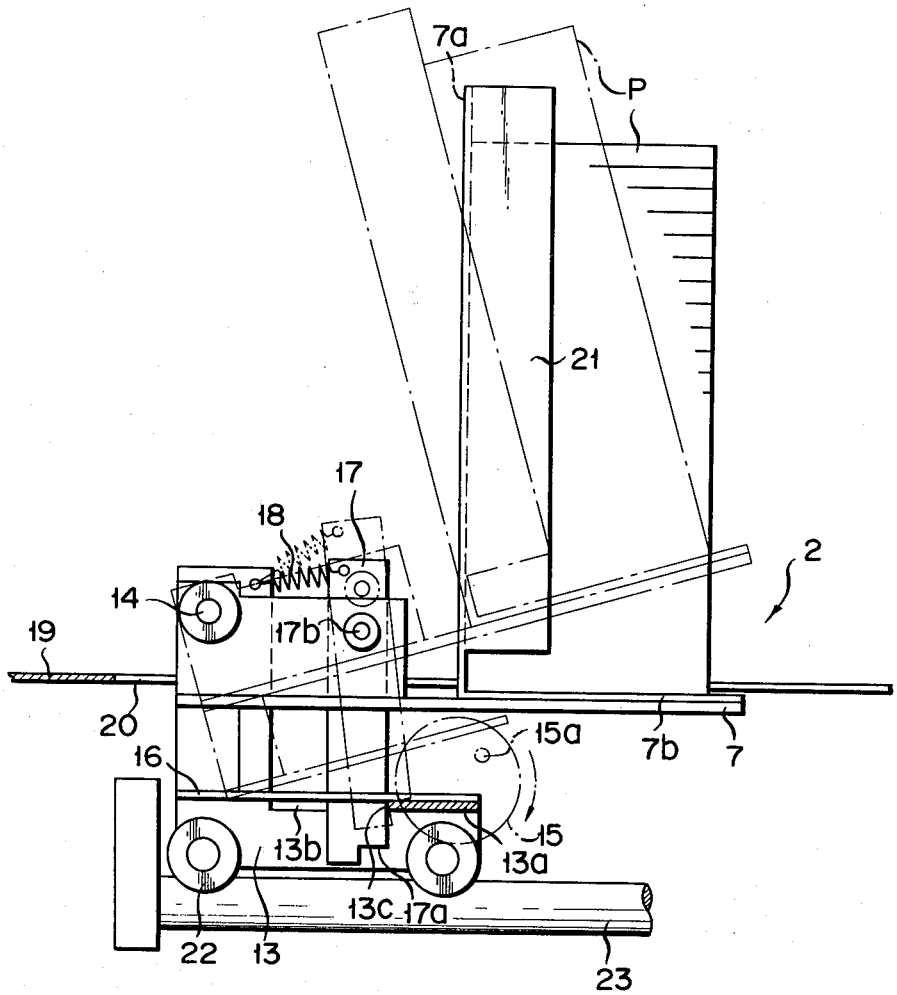
FIG. 5 is an enlarged view of explaining the mode of operation of the binding apparatus of FIG. 4, especially a feeding mechanism when an article is in the initial position.
Figure 6:
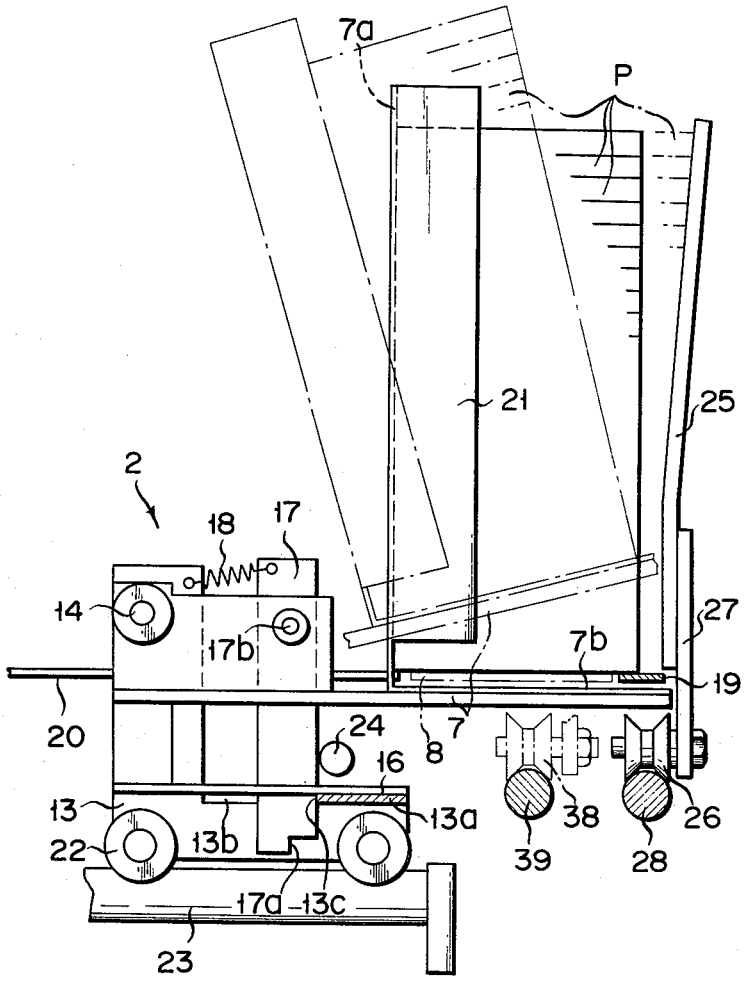
FIG. 6 is an enlarged view for explaining the mode of operation of the feeding mechanism when the article is at the terminal end position.

The feeding mechanism 2 is arranged as follows. Referring to FIGS. 4 to 6, the table 7 is pivotally mounted to a carrier 13 through a shaft 14. When a rotating cam 15 which is disposed at the initial end of a transfer passage of the carrier 13 (FIG. 5) rotates, a cam pin 15*a* engages with an operating plate 16 which is integrally formed with the table 7 to move its free end upward, as shown by the broken lines. The table 7 pivots in the counterclockwise direction about the shaft 14 so that the free end of the operating plate 16 which is raised when the table is inclined upward becomes the upper end.

In this condition, a locking lever 17 which is pivotally mounted on the table 7 and whose lower end extends through a groove 13*b* which is formed on a base 13*a* of the carrier 13 is lifted up through a shaft 17*b*. A lower notched step section 17*a* of the locking lever 17 extends above the upper surface of the base 13*a*. The locking lever 17 is constantly biased in the counterclockwise direction by a spring 18, so that when the lower notched step section 17*a* of the locking lever 17 extends above the upper surface of the base 13, the lower notched step section 17*a* pivots in the counterclockwise direction. Even if the pin 15*a* of the rotating cam 15 returns to the original position by being released from engagement, the lower notched step section 17*a* of the locking lever 17 is hooked at an opening edge 13*c* of the groove 13*b* formed on the base 13*a*, and the table 7 is locked in the inclined position.

On the other hand, the table 7 is placed in a nested state within a slit 20 extending along the feeding direction of a floor 19. The article P placed on the floor 19 is picked up by the table 7 which inclines. The article P is then held in the inclined condition in which the back of the article P is supported by a vertical backup plate 7*a*. Side guide plates 21 are integrally formed at both edges of the backup plate 7*a* opposing the longitudinal sides of the article P for maintaining the shape of the article P when the article P is transferred. Since the article P is fed on the carrier 13 while the table 7 is inclined, the article P is kept in shape by the backup plate 7*a*.

The carrier 13 is free to move reciprocally on a guide rail 23 through wheels 22. A driving mechanism (not shown) of the carrier 13 may be provided with a common system such as a system in which the carrier 13 is pulled by a belt, or a system in which driving of the carrier 13 is performed with a rack and a pinion. When the article P is picked up from the floor 19 onto the table 7, the table 7 is moved by the carrier 13 and the article P is fed to a position in front of the tape binding position of the binding mechanism 4.

On the other hand, a releasing pin 24 is arranged in the vicinity of the terminal end of the feeding passage of the table 7 in order to release the locking lever 17 from the locking engagement. As shown in FIG. 6, immediately before the table 7 reaches the end of the feeding passage, the locking lever 17 comes in contact with the releasing pin 24 and pivots against the urging force of a spring 18. Therefore, when the locking lever 17 is released, the lower notched step section 17*a* drops down completely within the groove 13*b* of the base 13*a* of the carrier 13. The table 7 is restored to the horizontal level. On the other hand, the carrier 13 advances slightly further and pushes out the article P, one of whose long sides is at the front in the feeding direction, to a guide plate 25 which is defined as a first stop member of the push-in mechanism 3 and which is disposed perpendicularly to the feeding direction. The long sides of the sheets of the article P are well aligned.

The guide plate 25 which is arranged on one side of a push-in passage 3*a* inclines gradually away from the backup plate 7*a* of the table 7, that is, the guide plate 25 inclines in the direction away from the push-in passage 3*a*. As the article P leans against the guide plate 25 as shown by the alternate long and two short dashes lines, the article P is prevented from being deformed.

When a surface plate 7*b* of the table 7 on which the article P is placed becomes horizontal, the table 7 becomes lower than the floor 19 so that the article P is placed on the surface of the floor 19.

Figure 7:
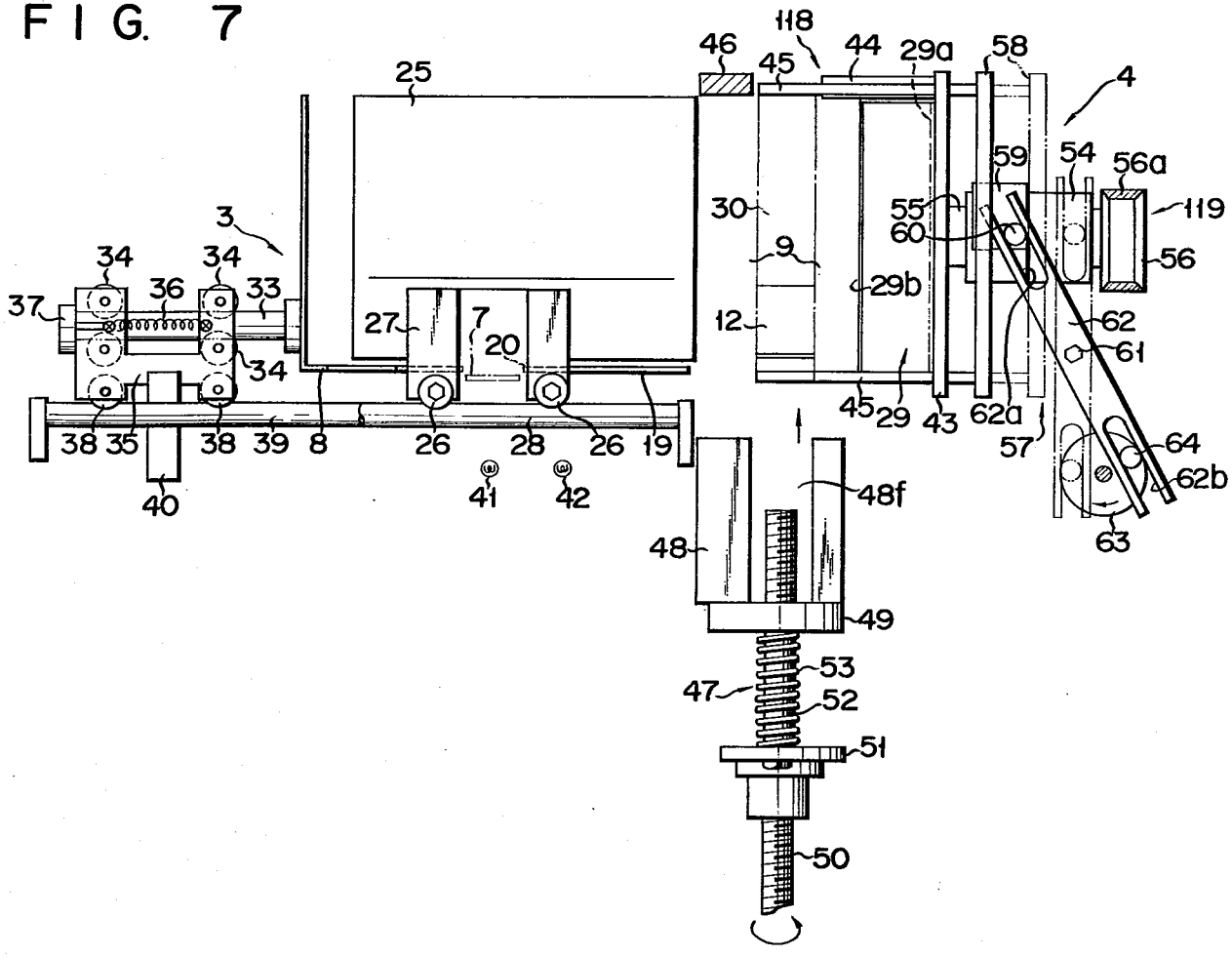
FIG. 7 is a side view taken in the direction A in FIG. 4.

The guide plate 25 prevents, with the push-in table 8, the article P from falling by guiding one side of the article P after the article P is pushed to the tape binding position 9 of the binding mechanism 4. The guide plate 25 is fixed at a supporting plate 27 which has wheels 26, as shown in FIGS. 6 and 7. The guide plate 25 slidably and reciprocally moves on a guide rail 28. This movement is performed in order to allow operation of the turning mechanism 5.

When the article P leans against the guide plate 25 on the floor 19 and the table 7 returns together with the carrier 13 to a position in which the pushout table 8 is not interrupted, the pushout table 8 moves the article P into the tape binding position of the binding mechanism 4 along the guide plate 25 within the push-in passage 3*a* so that the article P comes in tight contact with an abutment plate 29 as the second stop member at the tape binding position. The long sides of the sheets of the article P are aligned as described above and the short sides of the article P are then aligned by the abutment plate 29.

Figure 4:
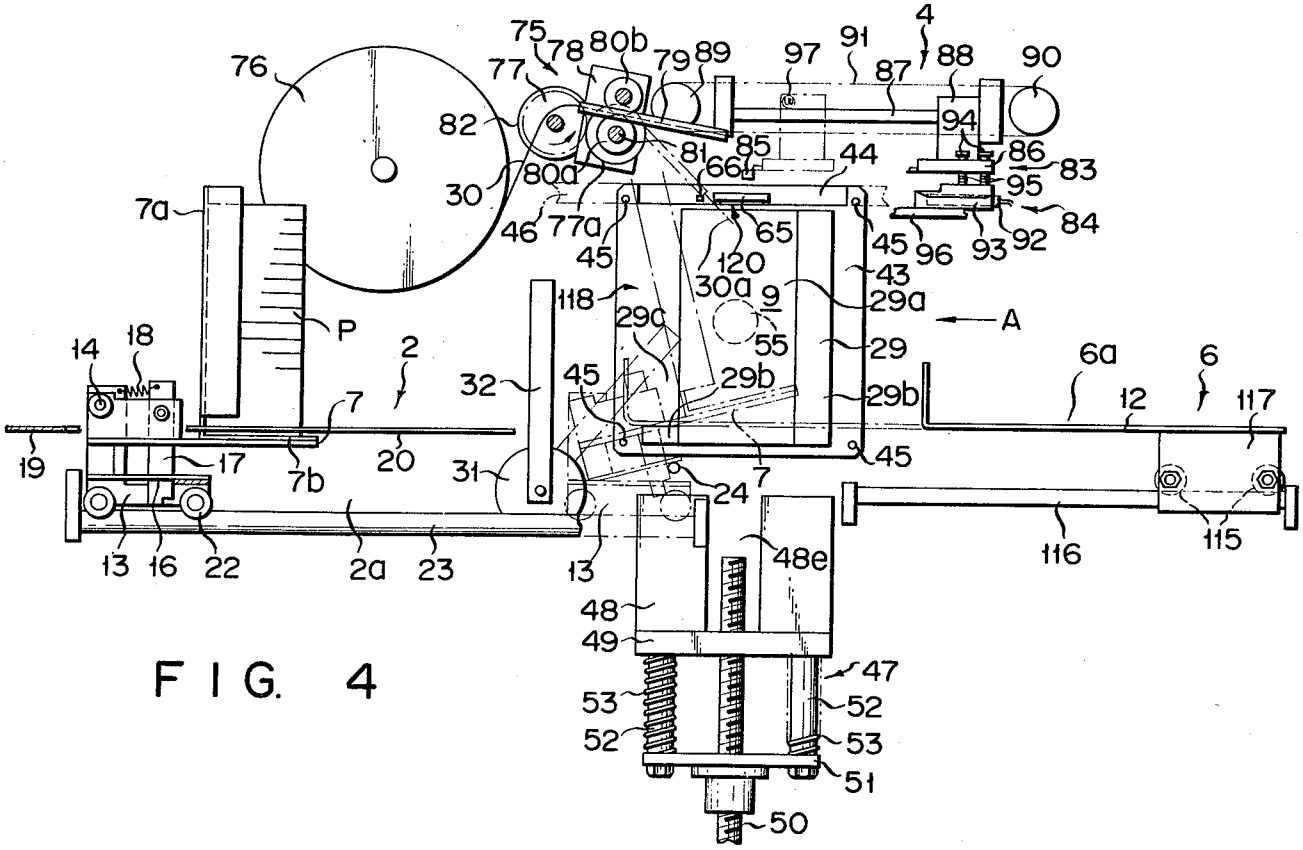
FIG. 4 is an enlarged front view of the binding apparatus of FIG. 3 according to the present invention.

The abutment plate 29 is of a convex shape as shown in FIGS. 4 and 7. The central convex surface 29*a* is used to align the short side of the article P, while flanged surfaces 29*b* extending in the front side are used to align the long side of the article. When the article P is pushed in its longitudinal direction, the short side of the article P comes in contact with the central convex surface 29*a* for alignment and a heat seal tape 30 as a binding body may be used for binding the article at the central position in the direction of length. Thereafter, when the article P is pushed in the transverse direction, the long side of the article P is aligned by the flanged surfaces 29*b*. The heat seal tape 30 is wrapped around the article P at a central position in the direction of width so as to cross the heat seal tape 30 previously applied. One of the flanged surfaces 29*b* of the abutment plate 29 is provided with a notched section 29*c* at the left flanged section as viewed from the front in order to prevent interruption of the removal of the article P from the tape binding position 9 when the first binding operation is completed. The article P is removed from the tape binding position 9 and is turned by 90 degrees. In order to compensate for the notched section 29*c*, a stop member 32 which is driven by a rotary solenoid 31 is rotatably disposed as shown in FIG. 4. The stop member 32 selectively swings to a stop position as shown by the alternate long and short dashed line in FIG. 4, so that the stop member 32 acts as an auxiliary abutment means. The stop member 32 is normally disposed in a position which is out of the path of the turning movement of the article, as shown by a solid line in FIG. 4.

The push-in table 8 is mounted to a guide shaft 33 as shown in FIG. 7. The guide shaft 33 is supported on a plurality of wheels 34 so as to be free to move in the axial direction with respect to a carrier 35. One end of a spring 36 is connected to the guide shaft 33, and the other end is connected to the carrier 35. A stop member 37 which is mounted to the rear end of the guide shaft 33 is constantly biased so as to be in contact with the rear end of the carrier 35.

The carrier 35 travels on wheels 38 on a guide rail 39 which is arranged parallel to the guide rail 28 to guide the guide plate 25. The carrier 35 is driven reciprocally by a carrier driving mechanism (not shown) with a belt system or a rack and pinion system.

A shield 40 is mounted to the carrier 35. First and second detectors 41 and 42 are spatially arranged along the track of the shield 40. These detectors 41 and 42 are respectively constituted by a light source and a light-receiving element. Where the article P is bound by the tape along the central line extending lengthwise of the article P, then the shield 40 is made to face the detector 41. Where the article P is bound by the tape along the central line extending crosswise of the article P, then the shield 40 is made to face the detector 42. When the optical axes of the detectors 41 and 42 are crossed by the shield 40, the article P stops travelling.

When the article P to be bound by the tape is formed by a pack of bills having such different measurements from those mentioned above as to cause the whole article to increase in volume, then, the movement of the push-in table 8 is stopped when the article P comes in contact with the abutment plate 29 before the optical axes of the detectors 41 and 42 are crossed by the shield 40. However, since the guide shaft 33 with the push-in table 8 is connected to the carrier 35 through the spring 36 as described above, the spring 36 allows the carrier 35 to further travel until the shield 40 is detected by the first detector 41 or the second detector 42.

As shown in FIGS. 4 and 7, the abutment plate 29 is fixed at the front surface of a rotating plate 43 of rectangular shape which constitutes part of a loop forming mechanism 118 for forming a loop of the heat seal tape 30 to bind the article P. The rotating plate 43 is provided along its upper front end with a pressing anvil block or upper pressing plate 44. Further, tape loop supporting pins 45 which are free to move reciprocally are arranged at the four corners of the rotating plate or member 43.

A stationary upper pressing plate 46 is arranged parallel to the upper pressing plate 44 in the horizontal direction with a space interposed for heat seal tape to be wound therebetween.

A lower pressing table 48 which is a main section of a pressing mechanism 47 and which presses the article P against the upper pressing plates 44 and 46 is arranged at the lower front section of the rotating plate 43. The pressing table 48 does not interfere with the operations of the heat seal tape 30, the push-in table 8 and the take-up table 12. For this purpose, the pressing table is divided into four pressing table segments **48*a*, 48*b*, 48*c* and 48*d* which jointly define a first groove 48*e*, and a second groove 48*f*. These grooves 48*e*, 48*f* intersect each other at right angles and serve as guide passages for the heat seal tape 30, the push-in table 8 and the take-up table 12, as shown in FIG. 8**.

Figure 8:
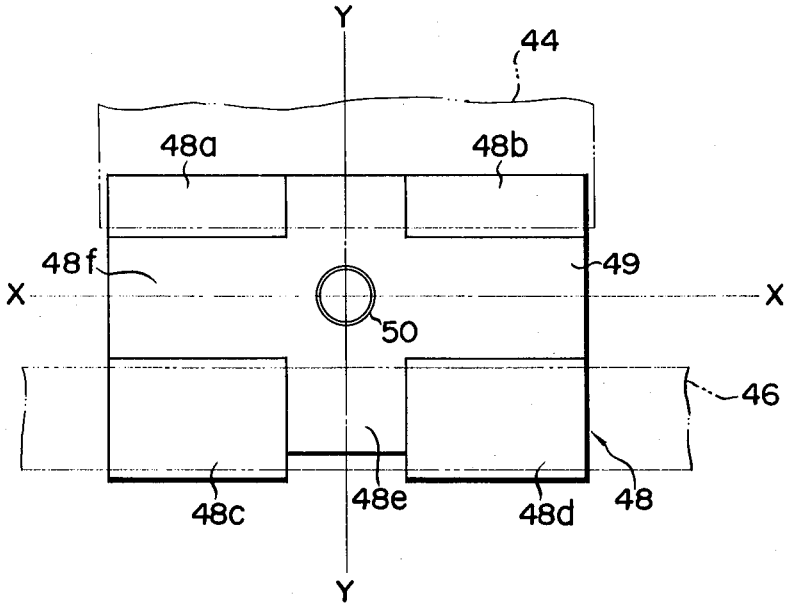
FIG. 8 is an enlarged plan view of a movable pressing table.

The positional relation among the four pressing table segments **48*a* to 48*d* and the two pressing plates 44 and 46 may be understood with reference to FIG. 8. Two pressing table segments 48*a* and 48*b* which have a smaller width than the other pressing table segments 48*c* and 48*d* correspond to the upper pressing plate 44 which is fixed at the rotating plate 43 as shown by the alternate and short dashed line in FIG. 8. The pressing table segments 48*c* and 48*d* correspond to the elongate stationary upper pressing plate 46. The first groove 48*e* which is formed along the axial line Y—Y matches with the push-in passage 3*a* so that the push-in table 8 travels in the groove 48*e*. The other groove 48*f* which extends along the axial line X—X matches with the tape winding direction and with an take-up passage 6*a* on which the take-up table 12 travels. Therefore, the take-up table 12 travels through the groove 48*f***.

The lower pressing table 48 is fixed to the upper surface of a base 49. The base 49 is free to move upward or downward by a pair of guide shafts 52 mounted on a movable block 51 which repeats the upward or downward movement in response to the rotation of a ball screw shaft 50. The base 49 is elastically supported by springs 53 which are fitted around the pair of guide shafts 52. The ball screw shaft 50 is rotated by a motor (not shown). The pressing table 48 moves upward and downward between the range of the upper pressing position and the lower releasing position.

The rotating plate 43 is arranged to be rotated by a rotating plate driving mechanism 119 (FIG. 7) in the clockwise direction in FIG. 4. As shown in FIG. 7, a driving shaft 55 which is rotatably supported in a housing 54 is mounted at the rear surface of the rotating plate 43. A pulley 56 which is mounted to a free end of the driving shaft 55 is driven through a driving belt **56*a*, so that the rotating plate 43** is driven.

The tape loop supporting pins 45 which project perpendicularly to the plane of the rotating plate 43 are pushed out to or retracted from the tape binding position by a pin operating mechanism 57 which controls reciprocal movement of the tape loop supporting pins. The tape loop supporting pins 45 slidably extend through guide holes which are formed at the four corners of the rotating plate 43. The rear ends of the tape loop supporting pins 45 are fixed at a pin supporting plate 58 which is disposed parallel to the rear plane of the rotating plate 43. The pin supporting plate 58 is rotatably mounted to a slide guide 59 which is mounted to the housing 54. This housing 54 supports the driving shaft 55 for driving the rotating plate 43. The slide guide 59 is mounted to the housing 54 so as to allow movement only in the axial direction. An upper end engaging groove **62*a* of an operating lever 62 which is free to swing around a supporting shaft 61 engages with a guide pin 60 extending from the slide guide 59. A lower end engaging groove 62*b* engages with a cam pin 64 of a cam 63. When the cam 63 rotates, the operating lever 62 is displaced by swinging around the supporting shaft 61 as shown by the alternate long and short dashed line. Therefore, the pin supporting plate 58 is moved in the direction away from the rotating plate 43. The four tape loop supporting pins 45 move backward from the tape winding position, and the loop tape wound around the pins is released from the tape loop supporting pins 45**.

Figure 9:
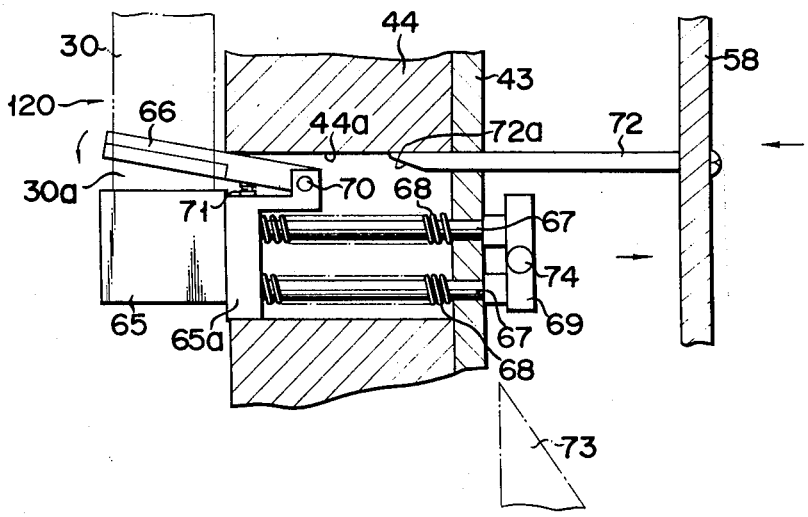
FIG. 9 is a partial enlarged sectional view of part of a clamping mechanism arranged on a pressing table.

Referring to FIG. 4, a clamping mechanism 120 which clamps the leading end of a tape and which has a pressing table 65 and a tape clamp 66 is arranged at the central section of the upper pressing plate 44. The pressing table 65 and the tape clamp 66 are arranged as shown in FIG. 9, so that they are pushed out or pulled in from the tape winding position. The pressing table 65 and the tape clamp 66 are arranged to be retracted into a groove **44*a* formed at the upper pressing plate 44. The pressing table 65 is fixed to the front ends of two supporting rods 67, the rear ends of which extend to the rear side of the plate 43 through the groove 44*a*. A compression spring 68 is fitted around each of the middle sections of the supporting rods 67. A connecting block 69 interconnects the rear ends of the supporting rods 67. Normally, the pressing table 65, which only leaves its guide section 65*a* in the groove 44*a*, is removed from the groove 44*a* by the urging force of the springs 68**.

The tape clamp 66 is disposed along one side of the pressing table 65 and the base end of the tape clamp 66 is pivoted by a pivot 70 at the guide section **65*a* of the pressing table 65. A compression spring 71 is arranged between the pressing table 65 and the tape clamp 66. The tape clamp 66 pivots about the pivot 70 to form a gap between the pressing table 65 and the tape clamp 66 in order to insert the heat seal tape 30 therebetween. When a clamping rod 72 which slidably extends through the rotating plate 43 is inserted along the side wall surface of the groove 44*a*, the tape clamp 66 is closed so as to be pressed against the side of the pressing table 65 by a tapered cam section 72***a* formed at the top of the clamping rod 72. The heat seal tape 30 is clamped between the tape clamp 66 and the pressing table 65.

The base end of the clamping rod 72 is fixed to the supporting plate 58 to which the tape loop supporting pins 45 are mounted, performing the opening and closing operation of the tape clamp 66 in synchronism with the forward and backward movement of the tape loop supporting pins 45. As described above, the tape clamp 66 extends from the groove 44*a* of the upper pressing plate 44 by the urging force of the compression springs 68. However, the pressing table 65 is pulled into the groove 44*a* when an engaging pin 74 extending perpendicularly from the connecting block 69 is displaced by engagement with a cam 73 which is able to move along the rear surface of the rotating plate 43. As indicated in FIG. 9, the cam 73 is normally located is a disengaged position in which the cam 73 is spaced from the pin 74.

As shown in FIG. 4, a tape supplying mechanism 75 is arranged at the upper left end of the tape binding position. The tape supplying mechanism 75 supplies the tape 30 between the tape clamp 66 of the clamp mechanism and the pressing table 65. However, the tape supplying mechanism 75 can act to pull excess tape to tighten the looped tape in the direction opposite to the feeding direction before the article P is bound with the heat seal tape 30. In other words, the tape supplying mechanism 75 acts as a tape tightening mechanism. The tape supplying mechanism 75 comprises a reel 76 around which the heat seal tape 30 is wound; a pair of reversible gears 77 and 77*a*; a pivotal tape guide supporting member 78 rotatable with the gear 77*a* upon rotation of the gear 77*a*; an elongate tape guide 79 fixed at the tape guide supporting member 78 and having a rectangular shape in cross section through which the leading end 30*a* of the tape 30 is led to the champing mechanism 120 and inserted between the tape clamp 66 and the pressing table 65; and a driving roller 80*a* and a pressing roller 80*b* which come in mutual contact in a condition in which the heat seal tape is interposed therebetween, and the driving roller 80*a* and the pressing roller 80*b* are partially inserted into the tape guide 76 through an opening (not shown) formed therein.

The driving roller 80*a* is coaxial with the gear 77*a*. The heat seal tape 30 is supplied when the driving roller 80*a* rotates in the clockwise direction in FIG. 4. The heat seal tape is pulled back when the driving roller 80*a* rotates in the counterclockwise direction.

When the gears 77 and 77*a* are slightly rotated in the direction shown by the arrow, that is, in the counterclockwise direction, by a rotary solenoid 82, as shown in FIG. 4, a supporting shaft 81 rotates around the supporting member 78 and the tape guide 79 moves from the tape non-supplying position shown by the solid line to the supplying position shown by the alternate long and short dashed line.

Figure 10:
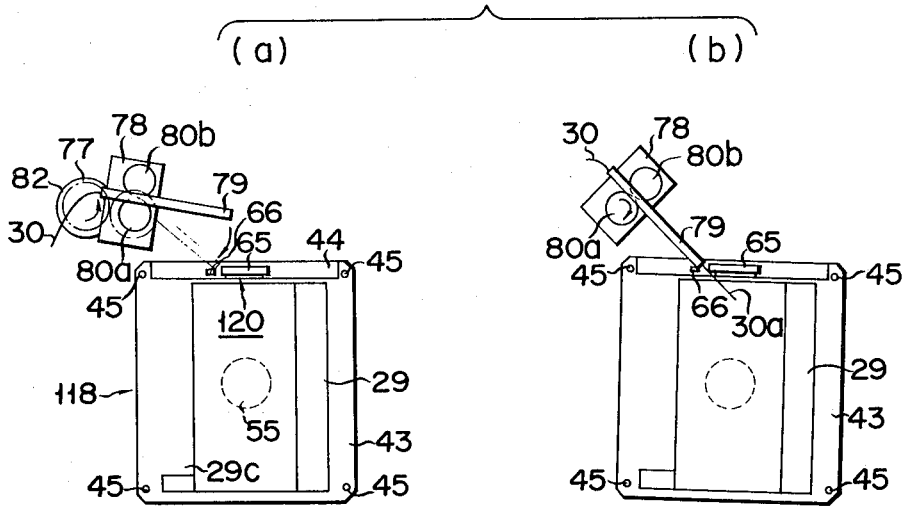
FIGS. 10(*a*) to 10(*h*) are views for illustrating the mode of operation of loop formation by a loop forming mechanism.
Figure 10:
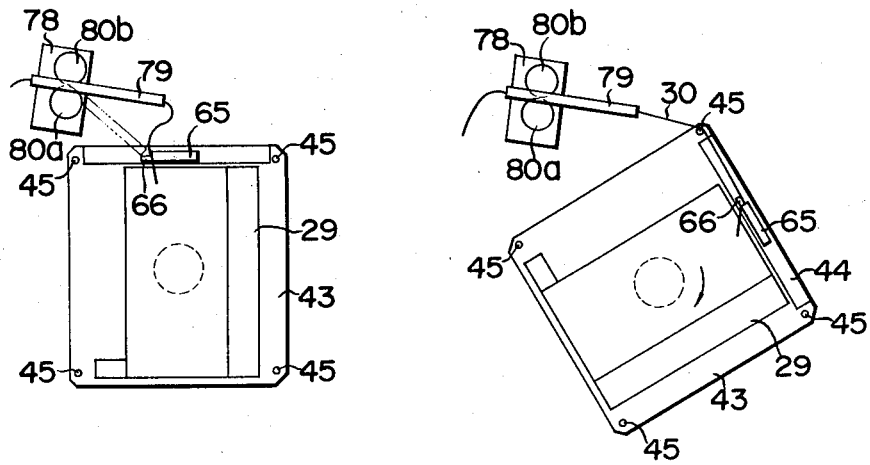
Figure 10:
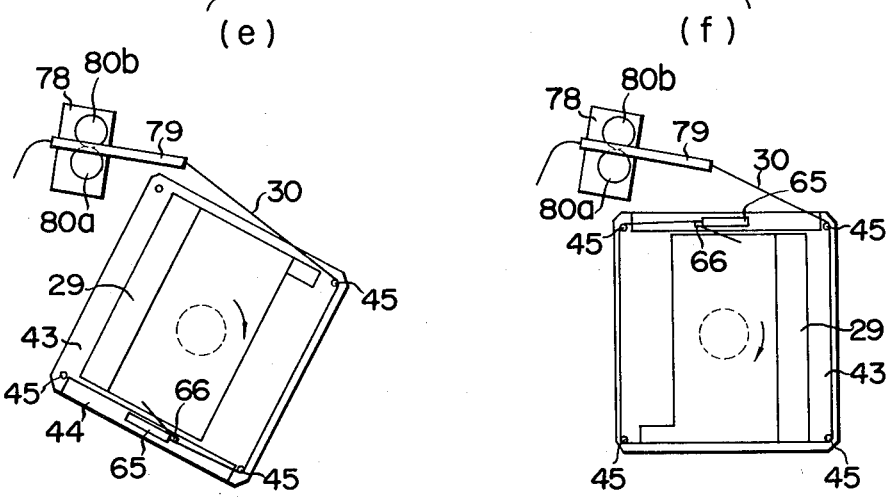
Figure 10:
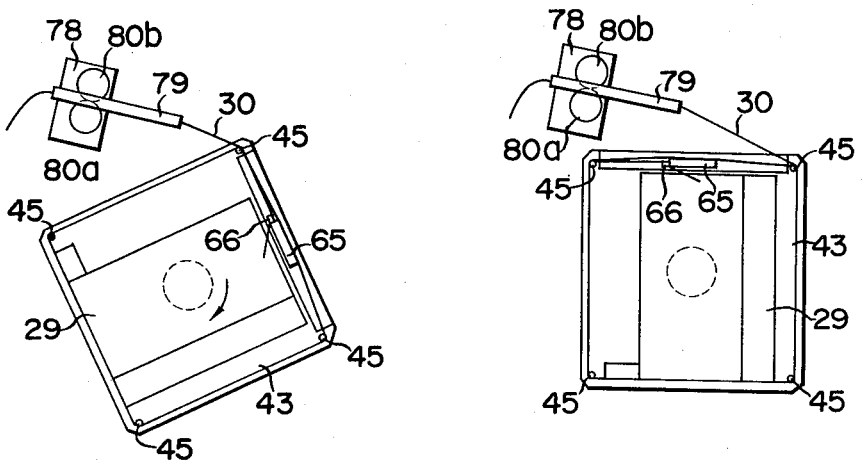

When the tape end 30*a* is supplied to the clamping mechanism 120, a tape loop of rectangular shape is formed on the four tape loop supporting pins 45 as sequentially shown in FIGS. 10(*a*) to 10(*h*).

FIGS. 10(*a*) and 10(*b*) show steps in which the leading end 30*a* of the heat seal tape 30 is supplied to the clamping mechanism 120. These steps are already described above. The supplied tape end is clamped by the clamping mechanism 120 shortly after the tape loop supporting pins 45 advance to the tape binding position. When the leading end 30*a* of the heat seal tape 30 is clamped, the supporting member 78 rotates in the reverse direction to lift the tape guide 79 to a non-supplying position, as shown in FIG. 10(*c*). As shown in FIGS. 10(*d*), 10(*e*) and 10(*f*), the tape clamp 66, the tape loop supporting pins 45 and the rotating plate 43 integrally formed therewith rotate once in the clockwise direction so that the heat seal tape 30 is wound around the tape loop supporting pins 45 by one turn. Furthermore, as shown in FIG. 10(*g*), when the rotating plate 43 continues to rotate in the same direction, the heat seal tape 30 passes above the pressing table 65. The rotating plate 43 stops rotating when two loops are formed around the rotating plate 43 at the initial position, as shown in FIG. 10(*h*). In accordance with the series of operations described above, a tape loop of rectangular shape is prepared in advance before the article P is bound with this loop.

A cutting mechanism 83, for cutting the heat seal tape 30 at a predetermined position, and a tape heatsealing mechanism 84, for adhering to the tape the cut end on the pressing table 65 by applying pressure and heat, are arranged above the tape binding position 9.

The cutting mechanism 83 has a slidable cutter 85 which is disposed above the upper pressing plate 46 and is slidable in the direction perpendicular to the heat seal tape 30, as shown in FIG. 4, and a movable cutter 86 which is not in contact with the slidable cutter in an inoperative condition and which moves toward the cutter 85 in an operative condition. The movable cutter 86 is mounted at the lower surface of a cutter holder 88 which is reciprocally movably guided by a guide shaft 87. The cutter holder 88 is connected to an endless belt 91 mounted through a driving roller 89 and a driven roller 90. The cutter holder 88 is free to move reciprocally in the right and left directions in the figure in correspondence with the forward and reverse rotation of the driving roller 89.

The tape heat-sealing mechanism 84 has an arrangement including a heating iron member or pressing iron member 93 with a heater 92 therein as the heating means.

The iron member 93 is jointed to the movable cutter 86 through mounting pins 94 and is able to slightly move downward and upward relative to the movable cutter 86. Compression springs 95 are fitted around the mounting pins 94 so that the iron member 93 is constantly biased downward elastically. Therefore, when the tape 30 is heat-sealed on the pressing table 65, sufficient pressure is provided for this purpose by the compression springs 95.

The iron member 93 moves with the movable cutter 86. However, a guide bar 96 is disposed along the moving passage so that the iron member 93 which slidably moves along the guide bar 96 and presses the heat seal tape 30 only at a position corresponding to the pressing table 65.

A detector 97 constituted by a lamp and a light-receiving element is disposed in the vicinity of the moving passage of the cutter holder 88 to detect that the cutter holder 88 reaches a cutting position to cut the heat seal tape 30. Shortly after the tape 30 is cut, reverse rotation of the driving roller 80*a* which tightens the heat seal tape 30 is stopped. Therefore, removal from the tape guide 79 of the tape is prevented.

Figure 11:
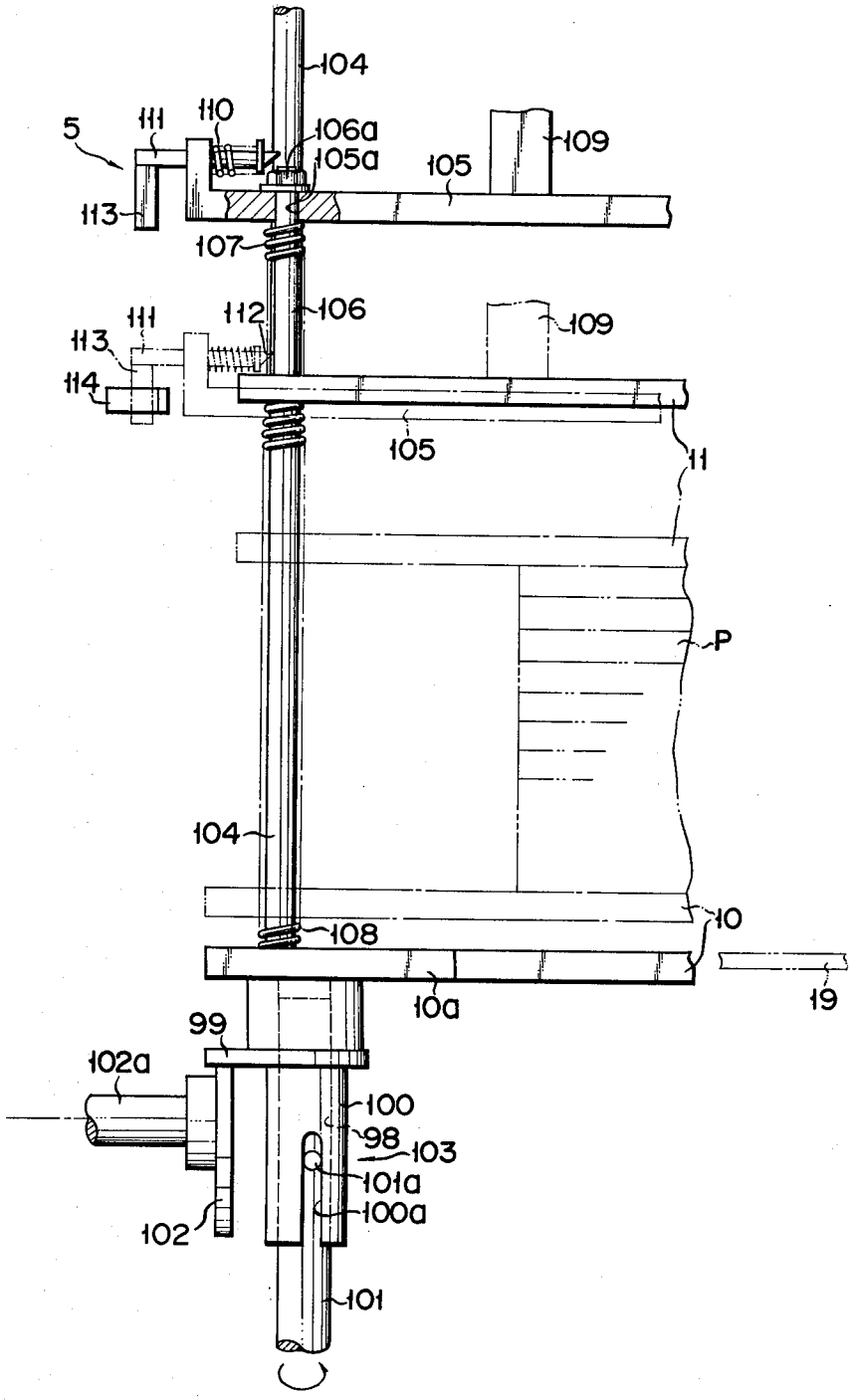
FIG. 11 is a partial enlarged view of a turning unit which turns an article by 90 degrees.

In this manner, when the article P is bound with the tape 30 at the central position in the direction of length, that is, bound in the transverse direction, the turning mechanism 5 removes the article P from the tape binding position to the push-in mechanism 3 by turning the article P by 90 degrees. The turning mechanism 5 is arranged as follows, as shown in FIG. 11. The turning mechanism 5 has the turning table 10 which supports the lower surface of the article P bound once and the clamping plate 11 which holds the upper surface of the article P. The turning table 10 has an arm 10*a*, and a mounting shaft guide 100 which has a slide hole 98 and a flange 99 is fixed at the lower end of the arm 10*a*. An upper end of a driving shaft 101 is slidably fitted in the slide hole 98. A slot 100*a* is formed in lower edge of the mounting shaft guide 100 in the axial direction. A pin 101*a* which projects from the driving shaft 101 is engaged in the slot 100*a*. Therefore, when the driving shaft 101 rotates, the shaft guide 100 also rotates so that the turning table 10 turns. The shaft guide 100 and the turning table 10 are slidable in the vertical direction independently of the driving shaft 101. The driving shaft 101 is connected to a driving source (not shown) so as to be reversibly rotated.

An eccentric cam 102 which is fixed at one end of a driving shaft 102*a* is in slidable contact with the flange 99 of the shaft guide 100. The shaft 102*a* has an axis along the horizontal direction. The flange 99 acts as a follower. When the eccentric cam 102 rotates, the turning table 10 is free to move, through the shaft guide 100, between the upper position shown by the alternate long and short dashed line in FIG. 11 and the lower position shown by the solid line. A driving unit 103 of the turning mechanism is constituted by the driving shaft 101, the shaft guide 100, the eccentric cam 102 and so on. A guide shaft 104 extends vertically on the turning table 10. The clamping plate 11 and a pressing plate 105 which is disposed parallel thereto are free to move upward and downward and are parallel to the turning table 10. Lower ends of a pair of vertical shafts 106 which movably extend through guide holes 105*a* in the upward and downward directions are arranged at the clamping plate 11. The guide holes 105*a* are formed in the pressing plate 105. Compression springs 107 which are fitted around the vertical shafts 106 are arranged between the clamping plate 11 and the pressing plate 105. The clamping plate 11 and the pressing plate 105 are biased in opposite directions so as to be separated. The pressing plate 105 is normally held in an upper position by a nut 106*a* against the biasing force of the springs 107. The nut 106*a* is fixed at the end of the shaft 106. A compression spring 108 is fitted around the shaft 106 between the turning table 10 and the clamping plate 11 so that the clamping plate 11 is normally held in the upper position where the clamping plate 11 is greatly separated from the turning plate 10. The vertical guide shaft 104 further extends upward through the clamping plate 11.

A pressing body 109 is disposed above the position where the article P is picked up by the pressing plate 105. Upon the descending operation of the pressing body 109, the body 109 engages with the pressing plate 105 so that the plate 105 is lowered against the biasing force of the spring 108.

As apparent from FIG. 11, the force applied to the pressing plate 105 is transmitted via the springs 107 to the clamping plate 11 so as to enable the clamping plate 11 to be moved downward against the biasing force of the spring 108. Therefore, the article P is clamped between the turning plate 10 and the clamping plate 11. FIG. 11 shows a condition in which the article P is clamped as shown by the alternate long and short dashed line.

A latch lever 111 which is constantly biased to press a pawl to the guide shaft 104 by a spring 110 is mounted at one end of the pressing plate 105. When the pressing body 109 urges the pressing plate 105 downward to a predetermined level, the pawl of the latch lever 111 engages with an engaging groove 112 which is formed at the guide shaft 104. Even if the pressing body 109 moves upward to disengage from the plate 105, the pressing plate 105 remains at the current lower position. Therefore, the clamping plate 11 is held at the clamping position. A latch knob 113 is arranged at the rear end of the latch lever 112. When the latch knob 113 engages with a latch lever release cam 114, the pawl of the latch lever 111 is released from the engaging groove 112, so that the pressing plate 105 and the clamping plate 11 move upward to the initial position by the urging force of the springs 107 and 108. Therefore, the article P is released from the turning mechanism.

Thereafter, the article P which is bound once is placed on the floor 19 at the push-in passage 3*a* of the push-in mechanism 3 and is ready to be pushed again to the tape binding position by the push-in mechanism 3. Although the short side of the article P is the leading edge, that is, the article is pushed along the longitudinal direction to the tape binding position 9 for first binding, the article P is turned by 90 degrees this time so that one of the long sides of the article becomes the leading edge for second binding. In other words, the direction of length of the article P is matched with the transverse direction. The article P is then pushed into the tape binding position 9, remaining in that position for second binding.

When the second binding operation is completed, the article P is bound with tape in a cross shape. This article P is removed from the tape binding position 9 by the take-up mechanism 6. Referring to FIGS. 4 and 7, the take-up mechanism 6 has the take-up table 12 which is pulled out and pushed in relative to the tape binding position 9. The width of the take-up table 12 is determined so that the table 12 can be fitted within the groove 48*f* formed on the pressing table 48. The take-up table 12 has wheels 115 and is mounted to a carrier 117 which is reciprocally moved on guide rails 116 by a take-up table driving mechanism (not shown) with a belt system or a rack and pinion system.

The mode of operation of the binding apparatus 1 with the above arrangement according to the present invention will be described with reference to FIGS. 12(*a*) to 12(*l*). As has been described in with reference to FIG. 6, the condition in FIG. 12(*a*) shows the article P which is fed from the feeding mechanism 2 to the push-in mechanism 3 and is placed on the floor 19, leaning against the guide plate 25. In this position, the pin supporting plate 58 is displaced in the direction apart from the rotating plate 43 so that the tape loop supporting pins 45 are retracted from the binding position and the tape clamp 66 is opened.

As has been described in FIGS. 10(*a*) to 10(*h*), the rotating plate 43 rotates twice to wind the heat seal tape 30 with two turns to prepare a tape loop.

Figure 12:
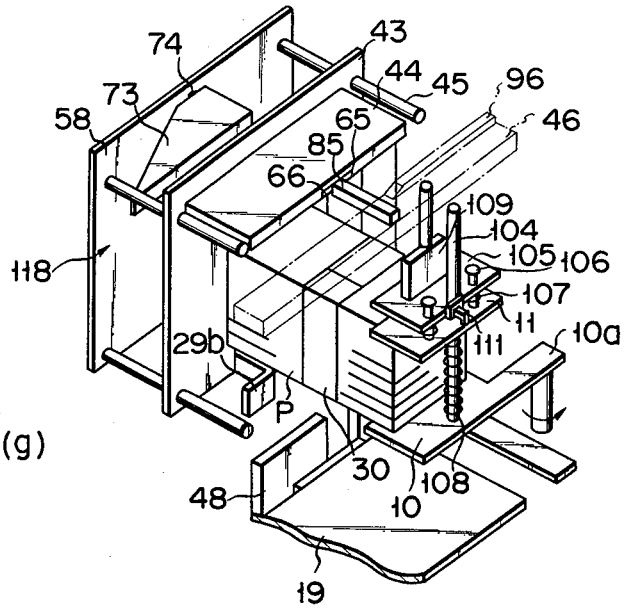
FIGS. 12(*a*) to 12(*l*) are perspective views for explaining the mode of operation in which a tape is wound around an article.
Figure 12:
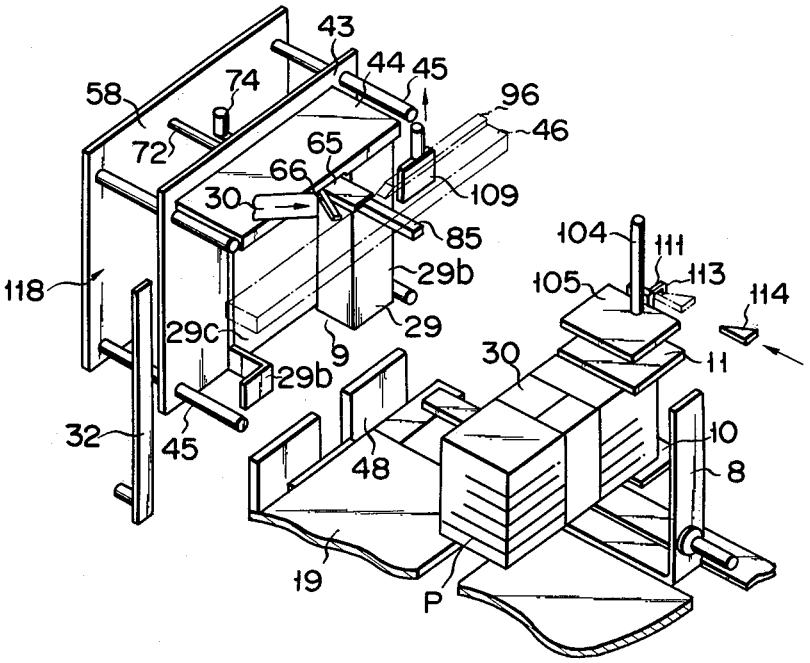

When the loop of the heat seal tape 30 is prepared, the article P is pushed by the push-in table 8 so that the leading edge of the article P comes in contact with the surface 29*a* of the abutment plate 29, which aligns the edge of the article P, as shown in FIG. 12(*b*). At the same time, the guide plate 25 still supports one side of the article P in order to prevent it from falling.

Subsequently, as shown in FIG. 12(*c*), the lower pressing table 48 moves upward to press the article P in cooperation with the upper pressing plates 44 and 46. The height of the article P is reduced and the push-in table 8 returns to the initial position. The lower side of the loop of the heat seal tape 30 is inserted in the groove 48*f* formed in the lower pressing table 48.

When the pressing operation for the article P is completed, the pin supporting plate 58 slides in the direction apart from the rotating plate 43 as shown in FIG. 12(*d*). The four supporting pins 45 are pulled out from the loop of the heat seal tape 30. As described above, since the lower side of the loop of the heat seal tape 30 is inserted in the groove 48*f* in the pressing table 48, the position of the loop is not misaligned.

On the other hand, when the tape loop supporting pins 45 are pulled out, the tape clamp 66 is opened. In this condition, the end of the heat seal tape 30 is sufficiently clamped between the pressing table 65 and the upper surface of the pressed article P. Therefore, the loop is kept in shape. When a condition in which the article P is sufficiently pressed is obtained, the guide plate 25 which has supported the article P for maintaining its shape is withdrawn in order to prevent interruption of the operation of the turning mechanism 5.

As shown in FIG. 12(*e*), when the tape loop supporting pins 45 are pulled out from the loop of the heat seal tape 30, the cutter 85 moves to the position between the double loop section of the heat seal tape 30 and the tape end section which is supported by the tape guide 79. When the cutter 85 reaches a predetermined position, the driving roller 80*a* of the tape supplying mechanism 75 rotates in the reverse direction so as to pull and tighten the heat seal tape 30. Therefore, the article P under pressure is further tightened. Under this condition, the leading end of the heat seal tape 30 is clamped between the article P and the pressing table 65, and this leading end is passed above the pressing table 65 after the first binding is performed.

When the heat seal tape 30 is tightly bound around the article P, the movable cutter 86 moves to perform cutting of the end of the tape in cooperation with the cutter 85.

When the heat seal tape 30 is cut, the detector 97 detects the position of the movable cutter 86 and outputs a signal. When the signal is output, the driving roller 80*a* stops rotating in the reverse direction, preventing removal of the heat seal tape 30 from the tape guide 79.

On the other hand, in correspondence with the movement of the movable cutter 86, the heating iron member 93 which is heated by the heater 92 to a predetermined temperature moves accordingly. In this condition, the heating iron member 93 is lifted by the guide bar 96 to prevent contact with the heat seal tape 30.

When the heating iron member 93 reaches the inclined guide surface at the end of the guide bar 96, the heating iron member 93 is lowered by the compression springs 95 so that heat sealing is performed on the pressing table 65 by the heating iron member 93. A heatsealing agent is coated on one surface of the heat seal tape 30. However, the article P may not be adhered to the heat seal tape 30.

While heat sealing is performed on the pressing table 65 by the heating iron member 93, the turning table 10 and the clamping plate 11, which are lifted so as not to be placed in contact with the floor 19 by the eccentric cam 102, are turned by 90 degrees in order to clamp the article P, as shown in FIG. 12(*f*).

After heat sealing of the heat seal tape 30 is performed by the heating iron member 93, the cam 73 engages with the pin 74 to pull the pressing table 65 and the tape clamp 66 away from the heat seal tape 30. In the pulling step mentioned, the tape clamp 66 is held open, with the result that the leading end of the heat seal tape 30 is not moved away.

After the pressing table 65 is inserted in the groove 44*a* of the upper pressing plate 44, the lower pressing table 48 is lowered.

In synchronism with the descending operation of the lower pressing table 48, the pressing body 109 also descends so that the pressing plate 105 is lowered accordingly. After the first binding, the article P is clamped by the turning mechanism 5 as shown in FIG. 12(*g*).

On the other hand, while the lower pressing table 48 descends and the article P is released from the upper pressing plate 44 and 46, the movable cutter 86 and the heating iron member 93 return to the initial position.

Thus, pressure is removed from the article P, the center of which is bound with a tape in the direction of width. The article P is held at its end portion in the longitudinal direction by the turning mechanism 5. As shown in FIG. 12(*h*), the article P is turned by 90 degrees, being removed from the tape binding position 9. That is, the shaft 101 is driven to turn the turning table 10 and the clamping plate 11 formed integrally therewith by 90 degrees. The turning table 10 moves to the same level as the floor 19 when the cam 102 rotates. The latch lever release cam 114 moves to act on the latch knob 113. Therefore, the latch lever 111 is released from the latching condition and the clamping plate 11 and the pressing plate 105 are lifted by the compression spring 108.

On the other hand, after the pressing body 109 is lifted, the cutter 85 is withdrawn. Further, the cam 73 returns to the initial position while the pressing table 65 and the tape clamp 66 extend at the binding position of the heat seal tape 30. In this condition, the clamping rod 72 remains in the withdrawn condition so that the tape clamp 66 remains open. The leading end of the heat seal tape 30 is inserted again to the tape clamp 66.

Sequentially, the heat seal tape 30 is wound around the tape loop supporting pins 45. A shown in FIG. 12(*i*), the article P on the push-in table 8 is moved to a position where the second detector 42 detects the article P. One end portion of the article P in the crosswise direction is pushed in until the end portion comes in contact with the flanged surfaces 29*b* of the abutment plate 29. In this condition, the stop member 32 swings to enter the stop position and determines the position of the article P.

As shown in FIG. 12(*j*), the article P is bound with the tape at a central position along the crosswise direction in the same manner as in the first binding operation.

The heat seal tape 30 is tightened and the take-up table 12 then moves below the article P through the groove 44*a* of the lower pressing table 48.

After the article P is sufficiently pressed by the lower pressing table 48, the table 48 descends as shown in FIG. 12(*k*) so that the article P which is bound with the tape in a cross shape moves on the take-up table 12. Thereafter, as shown in FIG. 12(*l*), the take-up table 12 moves to remove the article P from the tape binding position 9 and the stop member 32 swings so as not to interfere with the rotation of the tape loop supporting pins 45. Then, a loop of the heat seal tape 30 is formed again as shown in FIG. 12(*a*), and the next article P is fed in the binding position. In this manner, the sequential operation as shown in FIGS. 12(*a*) to 12(*l*) is repeated for the next article.

In the above embodiment, as an article to be bound a pack having a predetermined number of paper sheet bundles is used. However, the present invention is not limited to the particular embodiment. Various changes and modifications such as binding of cardboard boxes and other three-dimensional rectangular parallel-piped articles may be made within the spirit and scope of the present invention.

In the above embodiment, a heat seal tape is used as the binding material and the tape end is heat-sealed by the heating iron member. However, another binding means may be utilized.

Further, in the embodiment, a single mechanism which supplies a binding material and tightens the binding material is adopted. However, these two functions may be separately performed with two mechanisms.

In summary, according to the binding apparatus of the present invention, a loop of the binding material is formed in advance and the article to be bound is inserted in this loop so that the binding operation can be performed quickly. Furthermore, since the article inserted in the loop is pressed by a pressing mechanism in advance of the binding operation, tight binding is performed. Further, the tape cutting mechanism and the tape pressing mechanism are simple in construction. The various units of the binding apparatus according to present invention are constructed such that the components are arranged in an interdigitated state, rendering the entire apparatus small in size.

What we claim is:

1. An apparatus for binding an article with a tape in a binding position, comprising:

a push-in mechanism for pushing the article into the binding position through a push-in passage, a tape supplying mechanism for supplying the tape to the binding position;

a loop forming mechanism for forming a loop of a predetermined shape, said loop forming mechanism including a plurality of tape loop supporting members which are free to move between a forward position in which said loop supporting members engage with the loop so as to support the loop and a backward position in which said loop supporting members are withdrawn from the loop, and further including a rotating member which guides the movement of said loop supporting members to the forward and backward positions and which rotates integrally with said loop supporting members, a pull-in mechanism for displacing said loop suporting member from the forward position to the backward position to withdraw said supporting members from the loop, a tape tightening mechanism for winding the tape loop on the periphery of the article and tightening the tape by pulling the tape in a direction opposite to the tape feeding direction, a cutting mechanism for cutting a trailing end of the tape which is wound around the article, a tape press-sealing mechanism for press-sealing the trailing end of the tape to an adjacent surface thereof, a take-up mechanism for removing the bound article from the tape binding position through a take-up passage, and a pressing mechanism for pressing the article which is placed in the binding position, said pressing mechanism including stationary pressing means which is stationary in the direction of pressing and which corresponds to one surface of the article and movable pressing means which is movable in the direction of pressing in order to press the article against said stationary pressing means and which corresponds to the other surface of the article, said movable pressing means having a first groove which is aligned with said push-in passage and a second groove which is aligned with said take-up passage and which crosses said first groove.

2. An apparatus according to claim 1, wherein the tape loop is partially inserted in said second groove so that said second groove constitutes guide means for the tape loop.

3. An apparatus according to claim 1 or 2 wherein said stationary pressing means includes a pressing anvil block which is fixed to said rotating member so as to project substantially perpendicularly to a surface of said rotating member.

4. An apparatus according to claim 1, wherein said rotating member is a rectangular plate, and each of said tape loop supporting members is formed by a pin projectig substantially perpendicularly to the rotating surface of said rotating member, said pin being located at a corner of said rotating member of rectangular shape.

5. An apparatus according to claim 1, further comprising a clamping mechanism movable between a closing position in which a free end of the tape to be fed to the binding position is clamped and an opening position in which clamping is released, whereby said clamping mechanism clamps the tape free end at the closing position to fix the tape for rotation with said rotating member.

6. An apparatus according to claim 5, further comprising means for allowing the closing-opening operation of said clamping mechanism to be performed in accordance with the forward-backward operation of said tape loop supporting members, whereby said clamping mechanism remains in the closing position when said tape loop supporting members are in the forward position.

7. An apparatus according to claim 1, wherein said cutting mechanism has a first cutting member disposed in the vicinity of said binding position and a second cutting member spaced apart from said first cutting member in an inoperative condition and movable in the horizontal direction to cut the tape between the first and second cutting members, thereby performing a tape cutting operation.

8. An apparatus according to claim 7, wherein said pressing mechanism has a tape pressing table block which is fixed to said rotating member so as to rotate integrally with said rotating member and a pressing iron member which is spaced apart from said tape pressing table block in an inoperative condition and which moves in the horizontal direction to cooperate with said tape pressing table block in an operative condition.

9. An apparatus according to claim 8, further including connecting means for elastically connecting said second cutting member to said iron member to operate integrally therewith.

10. An apparatus according to claim 8 or 9, wherein said pressing iron member has heating means.

11. An apparatus according to claim 10, further including a guide bar for guiding said pressing iron member so as not to contact the tape until said iron member reaches said tape pressing table block.

12. An apparatus for binding an article with a tape in a binding position, comprising:

a push-in mechanism for pushing the article into the binding position through a push-in passage, a tape supplying mechanism for supplying the tape to the binding position, a loop forming mechanism for forming a loop of a predetermined shape, said loop forming mechanism including a plurality of tape loop supporting members which are free to move between a forward position in which said loop supporting members engage with the loop so as to support the loop and a backward position in which said loop supporting members are withdrawn from the loop, and further including a rotating member which guides the movement of said loop supporting members to the forward and backward position and which rotates integrally with said loop supporting members, a pull-in mechanism for displacing said loop supporting members from the forward position to the backward position to withdraw said supporting members from the loop, a tape tightening mechanism for winding the tape loop on the periphery of the article and tightening the tape by pulling the tape in a direction opposite to the tape feeding direction, a cutting mechanism for cutting a trailing end of the tape which is wound around the article, a tape press-sealing mechanism for press-sealing the trailing end of the tape to an adjacent surface thereof, a take-up mechanism for removing the bound article from the binding position through a take-up passage, and a feeding mechanism for feeding the article by a feeding passage to said push-in passage connected thereto in order to transfer the article to said push-in mechanism at the terminal end of said feeding passage, said feeding mechanism including guide rail means, carrier means which travels thereon, an L-shaped table which has a horizontal supporting surface and a vertical supporting surface for receiving the article and which is supported by said carrier means, including means for inclining said table to lean the article placed on said table against the vertical supporting surface and releasably locking said table at the inclined position, and releasing means disposed at a position where the article is received by said push-in mechanism so as to release locking of said inclining means.

13. An apparatus according to claim 12, further comprising a vertical guide plate which is disposed along one side of said push-in passage, an upper edge of said guide-plating being inclined outward with respect to said push-in passage.

14. An apparatus according to claim 12, wherein said feeding passage is substantially perpendicular to said push-in passage and is substantially parallel to said take-up passage.

15. An apparatus for binding an article with a tape along a tape winding direction in a binding position, comprising:

a push-in mechanism for pushing the article into the binding position through a push-in passage, a tape supplying mechanism for supplying the tape to the binding position, a loop forming mechanism for forming a loop of a predetermined shape, said loop forming mechanism including a plurality of tape loop supporting members which are free to move between a first position in which said loop supporting members engage with the loop to support the loop and a second position in which said loop supporting members are removed from the loop, and further including a rotating member rotating integrally with said loop supporting members, means for removing said supporting members from the loop, a tape tightening mechanism for winding the tape loop on the periphery of the article and tightening the tape by pulling the tape in a direction opposite to the tape feeding direction, a cutting mechanism for cutting a trailing end of the tape which is wound around the article, a tape press-sealing mechanism for press-sealing the trailing end of the tape to an adjacent surface thereof, a take-up mechanism for removing the bound article from the binding position through a take-up passage, a pressing mechanism for pressing the article which is placed in the binding position, said pressing mechanism including stationary pressing means which is stationary in the direction of pressing and which corresponds to one surface of the article, and movable pressing means which is movable in the direction of pressing to press the article against said stationary pressing means and which corresponds to the other surface of the article, and said stationary pressing means having a first pressing plate and a second pressing plate arranged parallel to the first pressing plate with a space for the tape interposed therebetween, and said movable pressing means having a groove which matches with the tape winding direction and serves as guide pasage for the tape.

16. An apparatus according to claim 15, wherein said first possessing plate of the stationary pressing means is fixed to said rotating member.

17. An apparatus according to claim 15, wherein said groove of said movable pressing means is aligned with said take-up passage.

18. An apparatus according to claim 15, wherein said cutting mechanism has a first cutting member disposed in the vicinity of said binding position and a second cutting member spaced apart from said first cutting member in an inoperative condition and movable in the horizontal direction to cut the tape between the first and second cutting members, thereby performing a tape cutting operation; said pressing mechanism includes a tape pressing table block; and said tape press-sealing mechanism includes a pressing iron member elastically connected to said second cutting member and having heating means and is movable in the horizontal direction between an inoperative position spaced apart from said tape pressing table block and an operative position in which the pressing iron member cooperates with said tape pressing table block, thereby performing press-sealing of the trailing end of the tape.

* * * * *